US007111800B2

(12) United States Patent
Berning et al.

(10) Patent No.: US 7,111,800 B2
(45) Date of Patent: Sep. 26, 2006

(54) FLUID SPRAY APPARATUS

(75) Inventors: Keith R. Berning, Jessup, MD (US); Russell D. Hester, Odenton, MD (US); Aland Santamarina, Columbia, MD (US); Ronald D. Stouffer, Silver Spring, MD (US)

(73) Assignee: Bowles Fluidics Corporation, Columbia, MD (US)

( * ) Notice: Subject to any disclaimer, the term of this patent is extended or adjusted under 35 U.S.C. 154(b) by 367 days.

(21) Appl. No.: 10/673,727

(22) Filed: Sep. 29, 2003

(65) Prior Publication Data

US 2004/0164189 A1 Aug. 26, 2004

Related U.S. Application Data

(60) Provisional application No. 60/425,835, filed on Nov. 12, 2002.

(51) Int. Cl.
*B05B 1/05* (2006.01)
*F15C 1/16* (2006.01)
*F15C 1/22* (2006.01)

(52) U.S. Cl. ..... 239/589.1; 137/809

(58) Field of Classification Search ..... 239/589.1, 239/284.1, 284.2; 137/809, 803, 808, 810, 137/814, 833, 834

See application file for complete search history.

(56) References Cited

U.S. PATENT DOCUMENTS 3,423,026 A * 1/1969 Carpenter ..... 34/191
3,741,481 A * 6/1973 Bauer ..... 239/589.1
4,052,002 A * 10/1977 Stouffer et al. ..... 239/4
4,151,955 A * 5/1979 Stouffer ..... 239/11
4,185,777 A * 1/1980 Bauer ..... 239/394
4,231,519 A * 11/1980 Bauer ..... 239/589.1
5,524,660 A * 6/1996 Dugan ..... 137/14
6,789,747 B1 * 9/2004 Kuch et al. ..... 239/284.1
6,904,626 B1 * 6/2005 Hester et al. ..... 4/541.6

* cited by examiner

*Primary Examiner*—Davis Hwu
*Assistant Examiner*—Darren Gorman
(74) *Attorney, Agent, or Firm*—Larry J. Guffey

(57) ABSTRACT

An improved spray head that is more effective and efficient at providing a wider range of desired spray distributions includes the following elements: (a) a plurality of fluidic oscillators, each oscillator having a fluidic circuit embedded in its top surface, with this circuit forming a path in which a fluid may flow through the oscillator, wherein these oscillators are stacked one on top of the other, with the sides of the oscillators being configured so that they stack such that the flow of fluid from adjoining oscillators in the stack have an angle of divergence between the centerlines of the planes defined by the flows from the outlets of the adjoining oscillators that is in the range of 2–5 degrees, (b) a plurality of cover plates, with each cover plate being proximate the top surface of one of the fluidic oscillators and attached to the oscillator so as to provide a seal against the flow of fluid from the oscillator's fluidic circuit, (c) a carrier assembly having a front and a rear surface and a cavity extending between these surfaces, with this cavity being configured so to receive and hold the stack of fluidic oscillators in the spray head, and (d) a stopper unit that attaches to the assembly's rear surface and seals it against leakage from the assembly's rear surface.

13 Claims, 24 Drawing Sheets

FLUIDIC OSCILLATOR OPERATING CONDITIONS:
(@1.1 GPM AND 10 PSI)

| | |
|---|---|
| AVG. DROPLET DIAMETER | = 1.7-1.9 mm |
| AVG. DROPLET SPEED | = 4.1- 4.4 m/sec |
| OSCILLATION FREQUENCY | = 45-50 Hz |

FIG. 15A
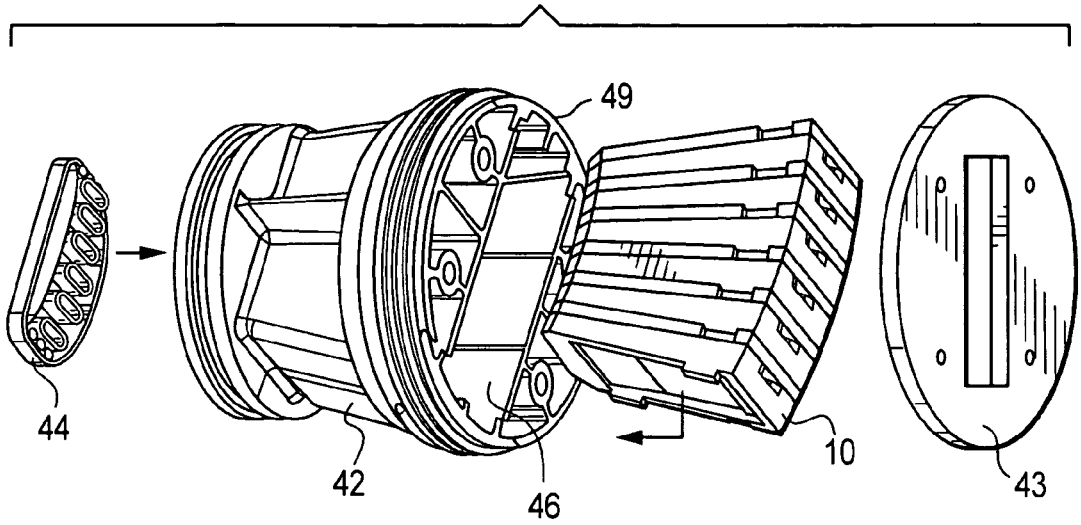
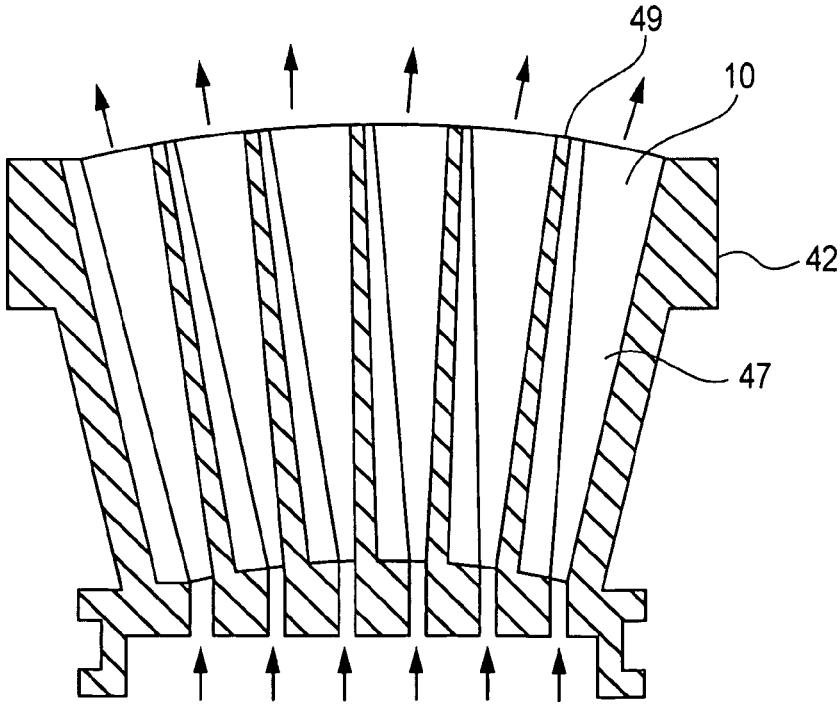
FIG. 15B

| FLUIDIC OSCILLATOR GEOMETRY: | | FLUIDIC OSCILLATOR OPERATING CONDITIONS: (@1.1 GPM AND 10 PSI) | |
|---|---|---|---|
| A, OUTLET AREA | = 40-60 $mm^2$ | AVG. DROPLET DIAMETER | = 1.2-1.4 mm |
| L, LENGTH | = 75-90 mm | AVG. DROPLET SPEED | = 4-6 m/SEC |
| FAN ANGLE | = 60 DEGREES | OSCILLATION FREQUENCY | = 20-30 Hz |

| FLUIDIC OSCILLATOR GEOMETRY: | | FLUIDIC OSCILLATOR OPERATING CONDITIONS: (@1.1 GPM AND 10 PSI) | |
|---|---|---|---|
| A, OUTLET AREA | = 2-3 $mm^2$ | AVG. DROPLET DIAMETER | = 1.6-1.9 mm |
| L, LENGTH | = 20-25 mm | AVG. DROPLET SPEED | = 3-6 m/SEC |
| FAN ANGLE | = 60 DEGREES | OSCILLATION FREQUENCY | = 40-60 Hz |

| FLUIDIC OSCILLATOR GEOMETRY: | | FLUIDIC OSCILLATOR OPERATING CONDITIONS: (@1.1 GPM AND 10 PSI) | |
|---|---|---|---|
| A, OUTLET AREA | = 15-25 $mm^2$ | AVG. DROPLET DIAMETER | = 1.0-1.4 mm |
| L, LENGTH | = 40-55 mm | AVG. DROPLET SPEED | = 5-7 m/SEC |
| FAN ANGLE | = 40-60 DEGREES | OSCILLATION FREQUENCY | = 60-80 Hz |

| FLUIDIC OSCILLATOR GEOMETRY: | | FLUIDIC OSCILLATOR OPERATING CONDITIONS: (@1.1 GPM AND 10 PSI) | |
|---|---|---|---|
| A, OUTLET AREA | = 85-100 $mm^2$ | AVG. DROPLET DIAMETER | = 1.2-1.8 mm |
| L, LENGTH | = 60-75 mm | AVG. DROPLET SPEED | = 5-7 m/SEC |
| FAN ANGLE | = 30-60 DEGREES | OSCILLATION FREQUENCY | = 40-60 Hz |

| FLUIDIC OSCILLATOR GEOMETRY: | | FLUIDIC OSCILLATOR OPERATING CONDITIONS: (@1.1 GPM AND 10 PSI) | |
|---|---|---|---|
| A, OUTLET AREA | = 2-3 $mm^2$ | AVG. DROPLET DIAMETER | = 1.2-1.4 mm |
| L, LENGTH | = 20-25 mm | AVG. DROPLET SPEED | = 6-8 m/SEC |
| FAN ANGLE | = 30-90 DEGREES | OSCILLATION FREQUENCY | = 60-80 Hz |

| FLUIDIC OSCILLATOR GEOMETRY: | | FLUIDIC OSCILLATOR OPERATING CONDITIONS: (@1.1 GPM AND 10 PSI) | |
|---|---|---|---|
| A, OUTLET AREA | = N/A $mm^2$ | AVG. DROPLET DIAMETER | = N/A mm |
| L, LENGTH | = 50-60 mm | AVG. DROPLET SPEED | = 7-10 m/SEC |
| FAN ANGLE | = N/A DEGREES | OSCILLATION FREQUENCY | = 15-40 Hz |

FLUID SPRAY APPARATUS

CROSS-REFERENCE TO RELATED APPLICATION

This application claims the benefit of U.S. Provisional Patent Application No. 60/425,835, filed Nov. 12, 2002 by Ronald D. Stouffer.

BACKGROUND OF THE INVENTION

1. Field of the Invention

This invention relates to fluid handling processes and apparatus. More particularly, this invention relates to new methods and apparatus for distributing the flow of fluid from a spray head.

2. Description of the Related Art

Spray heads are commercially available in numerous designs and configurations for use in showers, faucets, whirlpools, sprinklers, and industrial processes. For example, in shower applications, one may encounter spray heads being used as either showerheads or body sprays. As a showerhead, the spray is placed at a height that is front of or slightly higher than a user's head and it, at typical flowrates of 2.0–2.5 gpm, serves as the primary or only means of supplying liquid to the user. As a body spray, one or more rows of such sprays are typically placed in a shower's front or side walls. At typical flowrates of 1.5–2.5 gpm, body sprays typically serve as ancillary sprays which have smaller target areas than showerheads.

While many spray heads are designed and sold for their decorative styling, there are a great number of different showerhead mechanisms which are intended to improve or change one or more characteristic of the water spray pattern. Any particular spray pattern may be described by the definable characteristics of the spray pattern, including the volume flow rate of the spray, the spray's area of coverage, the spatial distribution of spray droplets in a plane perpendicular to the direction of flow of the spray, the average spray droplet velocities, the average size of the spray droplets, and the frequency of the spray droplets impacting on an obstacle in the path of the spray. Furthermore, these characteristics may be used to adapt a spray pattern for specific service purposes, including a pulsating jet stream for massaging of muscles, a more uniform soothing spray to provide maximum wetting.

Stationary spray heads with fixed jets are the simplest of all spray heads, consisting essentially of a water chamber and one or more jets directed to produce a constant pattern. Stationary spray heads with adjustable jets are typically of a similar construction, except that it is possible to make some adjustment of the jet opening size and/or the number of jets utilized. However, these types of jets provide a straight often piercing directed flow of water.

These stationary spray heads cause water to flow through its apertures and contact essentially the same points on a user's body in a repetitive fashion. Therefore, the user feels a stream of water continuously on the same area and, particularly at high pressures or flow rates, the user may sense that the water is drilling into the body, thus diminishing the positive effect derived from such a spray head. In order to reduce this undesirable feeling, various attempts have been made to provide spray heads that vary or enlarge the areas being impacted by the sprays.

Examples of such spray heads seeking broader patterns of spray droplet distribution include the showerheads disclosed in U.S. Pat. No. 3,691,584 (Drew et al.), U.S. Pat. No. 4,944,457 (Brewer), U.S. Pat. No. 5,577,664 (Heitzman) and U.S. Pat. No. 6,360,965 (Clearman).

U.S. Pat. No. 4,944,457 discloses an oscillating spray head that uses an impeller wheel mounted to a gear box assembly which produces an oscillating movement of the nozzle. See FIG. 1.

Similarly, U.S. Pat. No. 5,577,664 discloses a spray head having a rotary valve member driven by a turbine wheel and gear reducer for cycling the flow rate through the housing between high and low flow rates, causing the spray droplets to be distributed over broader areas. Additionally, the turbine wheels of this spray head may be used to control the frequency of the spray droplets impacting on an obstacle in the path of the spray, thereby using this phenomena to cause the flow from the spray to exhibit pulsating features for massaging purposes. See FIGS. 2A–2B. For an example of another type of massaging shower head, see U.S. Pat. No. 5,467,927 (Lee).

All of these spray heads require extremely complex mechanical structures in order to accomplish the desired broader distribution of a spray's droplets. Consequently, these mechanisms are prone to failure due to wear on various parts and mineral deposits throughout the structure.

U.S. Pat. No. 3,691,584 also discloses a spray head that attempts to efficiently distribute its droplets over a wider area. See FIG. 3. It utilizes a nozzle mounted on a stem that rotates and pivots under forces placed on it by water entering through radially disposed slots into a chamber around a stem. Although this spray head is simpler than those of Brewer, Heitzman or Lee, it still includes a large number of piece requiring precise dimensions and numerous connections between pieces. Furthermore, the Drew spray head relies upon small openings for water passageways and is subject to mineral buildup and plugging with particles.

U.S. Pat. No. 6,360,965 discloses a spray head, see FIG. 4, that distributes its droplets over a wider area by utilizing a means for wobbling the nozzle assembly of such a spray head. FIG. 5 shows the reported typical spatial distribution of spray droplets from such a spray head. Meanwhile, FIGS. 6A–6D which are reproduced from U.S. Pat. No. 6,360,964 are reportedly graphical representations of the uniformity of the spray patterns from four shower heads, including three commercially available shower heads and a shower head made in accordance with FIG. 5. The droplets were collected at a specified distance from the spray head in a row of glass tubes. The graphs represent a side view of the liquid collected in the tubes. The spray head of FIG. 5 is seen to provide the most uniform distribution of liquid across the width of the spray pattern.

In addition to using various forms of mechanical parts in such spray heads to vary the flow from them, it is also well known in the art that an assortment of fluid oscillating devices which have no moving parts in spray heads can be used to provide a wide range of fluid droplet distributions. Such fluid oscillating devices are known as fluidic oscillators and employ especially constructed fluid circuits or pathways to cyclically deflect the flows from spray nozzles.

FIG. 7 from U.S. Pat. No. 4,052,002 (Stouffer & Bray) and FIGS. 8A–8B from U.S. Pat. No. 4,151,955 (Stouffer) demonstrate some of the flow patterns that can be achieved with various types of fluidic oscillators.

FIG. 7 shows what can be considered to be the essentially two-dimensional, planar flow pattern (i.e., in the x-y plane of the oscillator) of a very small diameter, essentially round jet of liquid that issues from the oscillator and then breaks into droplets which are distributed transversely (i.e., in the y-direction) to the jet's generally x-direction of flow. FIG. 8A shows a similar flow pattern. However, this particular flow pattern owes its existence in large part to the specific geometry of this oscillator, especially the distance between this oscillator's island and its outlet.

When this distance is not sufficiently large, the flow from this oscillator is seen to take on a fully three dimensional flow pattern. See FIG. 8B. In this instance, the flow from the oscillator no longer resembles that of a constant round jet whose droplets are distributed in the x-y plane. Instead, the shape of the flow exiting the oscillator is seen to change with time. Somewhat surprisingly, it is seen to have a significant component in the z-plane, which is normal to the x-y plane of the oscillator. The shape of the flow at the oscillator's outlet can be described as that of a thin sheet of fluid in the z-x plane. However, the height (i.e., in the z-direction) of this sheet varies as a function of time and is seen to cycle between instances in which it has considerable height and other instances in which it contracts until it's height is such that it more closely resembles that of an approximate round jet.

FIG. 8B attempts to illustrate this three-dimensional flow pattern. The varying height sheet of liquid (i.e., h(t)) from the oscillator is seen to be swept back and forth in the x-y plane. The points where the sheet shrinks down to its minimum height are denoted by the letters M in FIG. 8B. The resulting wetting pattern that is produced on a downstream target surface is diamond-shaped. The diamond width W is dependent upon the sweep angle in the x-y plane of the oscillator; the diamond height H depends upon the maximum height of the sheet.

Even when the flows from fluidic oscillators are essentially two-dimensional, as in FIGS. 7 and 8A, they can differ in another important aspect or characteristic as it relates to their suitability for use in various spray head or showerhead applications. This characteristic is the frequency with which the flows are being swept from side-to-side.

The fluidic oscillator of FIG. 7 typically can be shaped so that its oscillating frequency is in the range of that which can be sensed by human's tactile sensations (< about 60 Hertz or cycles per second (cps)); thus this oscillator could be used to provide one with a massaging sensation as the droplets impact on one's skin. Meanwhile, the oscillator of FIG. 8A, for a wide range of its applicable geometries, tends to exhibit three-dimensional flow patterns and oscillating frequencies that are considerably above 60 hertz, which results in the pulsating nature of such a flow not be discerned when it impacts on one's skin.

FIG. 9 from U.S. Pat. No. 4,151,955 discloses a showerhead that employs a fluidic oscillator that essentially combines two fluidic circuits of the types shown in FIGS. 7 and 8A. For this application, the circuit of FIG. 8A is configured so as to yield a three-dimensional flow pattern.

Despite much prior art relating to spray heads and showerheads or body spray devices, there still exists a need for further technological improvements in this area. For example, to get a uniform distribution of droplets over a relatively large surface area (e.g., a 400 $cm^2$ area at a distance of 30 cm from the spray's exit), large diameter, so called rain-maker shower heads are often used.

However, such rain-maker shower heads usually have many fine diameter orifices that can become clogged and their resulting sprays are often characterized as: (a) having low velocity (e.g., < or ~3 m/sec), small diameter (e.g., <1.5 mm) droplets which are inadequate for some bathing purposes (e.g., washing one's hair) if such shower heads are operated within governmentally imposed flow rates (e.g., 2.5 gpm), and (b) being thermally inefficient because of the comparatively higher heat losses experienced by small diameter, as opposed to large diameter, droplets in such sprays. Unfortunately, there are no individual spray heads in today's marketplace that can provide uniform coverage of large surface areas with large diameter (e.g., > or ~2 mm), high velocity (e.g., > or ~4 m/sec) droplets.

Improved spray heads continue to be needed that can provide controllable sprays of droplets that prove to be more efficient and effective in assorted applications, such as by providing better performance or greater tactile pleasures in many showerhead and body spray applications.

SUMMARY OF THE INVENTION

Recognizing the need for the development of improved spray heads to more effectively and efficiently provide a wider range of desired spray distributions, the present invention is generally directed to satisfying the needs set forth above and overcoming the disadvantages identified with prior art devices and methods.

In accordance with the present invention, the foregoing need can be satisfied by providing a spray head that in a preferred embodiment includes the following elements: (a) a plurality of fluidic oscillators, each oscillator having a fluidic circuit embedded in its top surface, with this circuit forming a path in which a fluid may flow through the oscillator, wherein these oscillators are stacked one on top of the other, with the sides of the oscillators being configured so that they stack such that the flow of fluid from adjoining oscillators in the stack have an angle of divergence between the centerlines of the planes defined by the flows from the outlets of the adjoining oscillators that is in the range of 2–5 degrees, (b) a plurality of cover plates, with each cover plate being proximate the top surface of one of the fluidic oscillators and attached to the oscillator so as to provide a seal against the flow of fluid from the oscillator's fluidic circuit, (c) a carrier assembly having a front and a rear surface and a cavity extending between these surfaces, with this cavity being configured so to receive and hold the stack of fluidic oscillators in the spray head, and (d) a stopper unit that attaches to the assembly's rear surface and seals it against the flow of fluid from the assembly's rear surface.

Thus, there has been summarized above, rather broadly, the present invention in order that the detailed description that follows may be better understood and appreciated. There are, of course, additional features of the invention that will be described hereinafter and which will form the subject matter of any eventual claims to this invention.

BRIEF DESCRIPTION OF THE DRAWINGS

FIG. 2B shows the sectional view taken along the line 3—3 of FIG. 2A.

FIG. 15A shows a preferred embodiment of the carrier assembly of the present invention.

FIG. 15B shows another preferred embodiment of the carrier assembly of the present invention.

DESCRIPTION OF THE PREFERRED EMBODIMENTS

Figure 1:
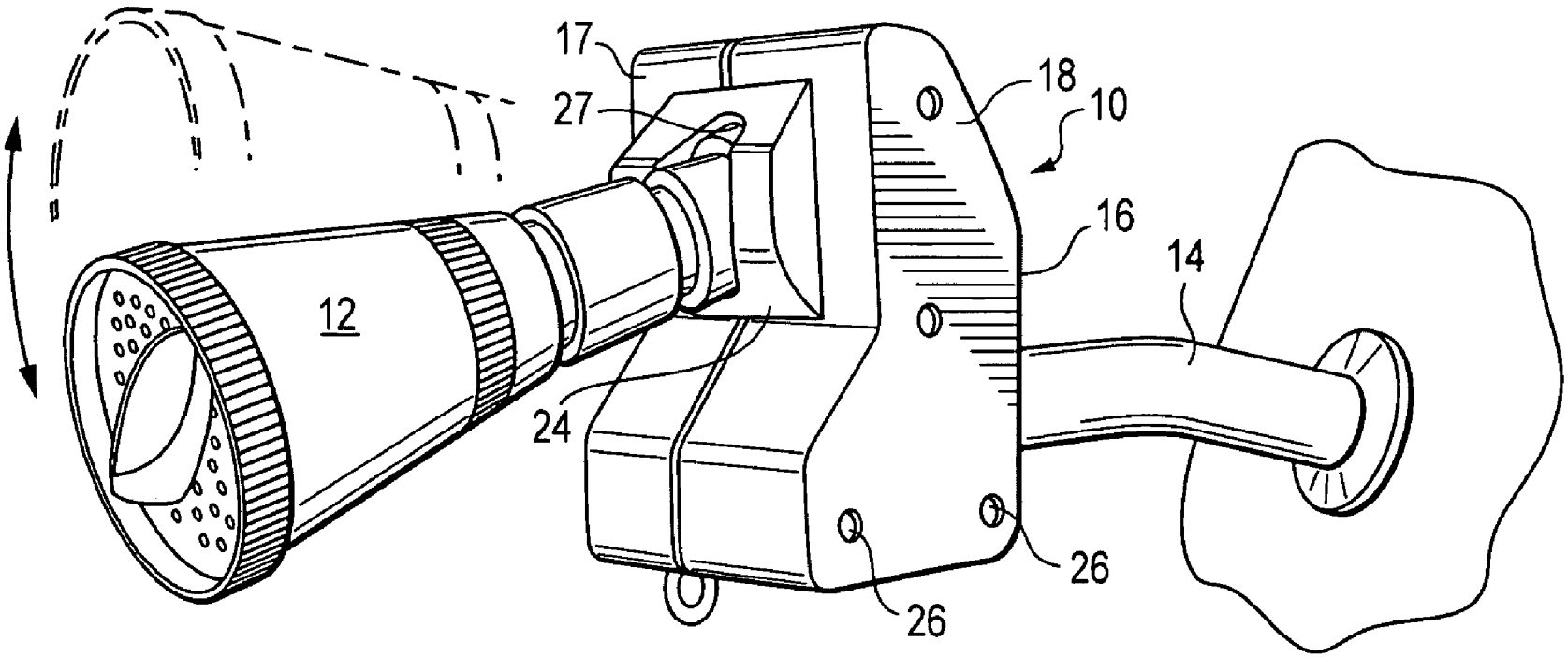
FIG. 1 (PRIOR ART)
FIG. 1 illustrates the prior art, oscillating spray head disclosed in U.S. Pat. No. 4,944,457.
Figure 2B:
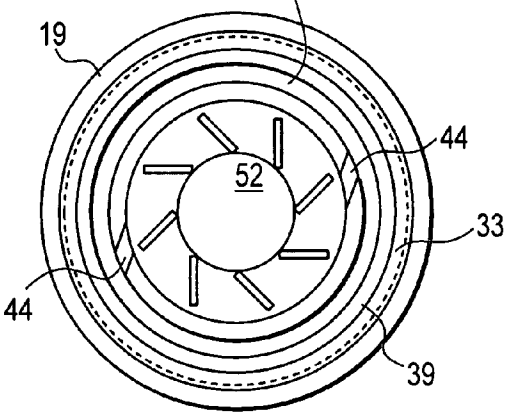
FIG. 2B (PRIOR ART)
FIGS. 2A–2B illustrate the prior art, spray head disclosed in U.S. Pat. No. 5,577,664, where
Figure 2A:
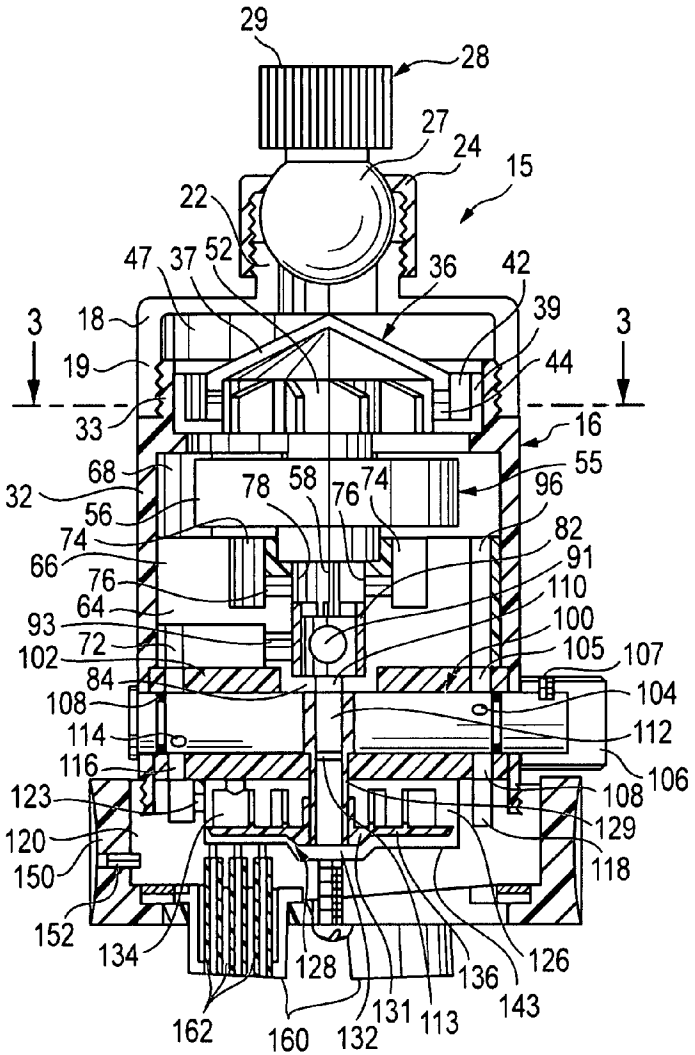
FIG. 2A (PRIOR ART)
Figure 3:
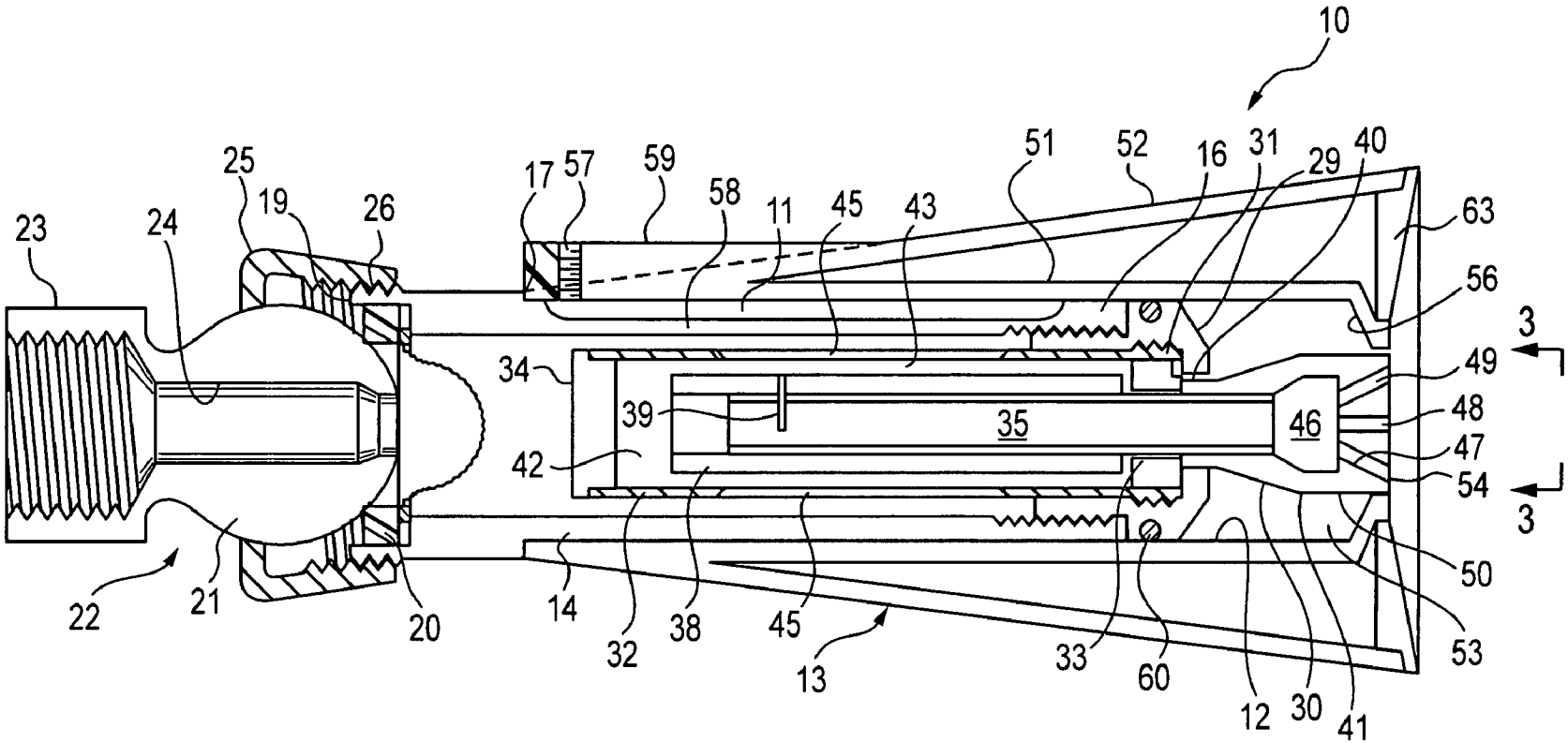
FIG. 3 (PRIOR ART)
FIG. 3 illustrates the prior art, spray head disclosed in U.S. Pat. No. 3,691,584.
Figure 4:
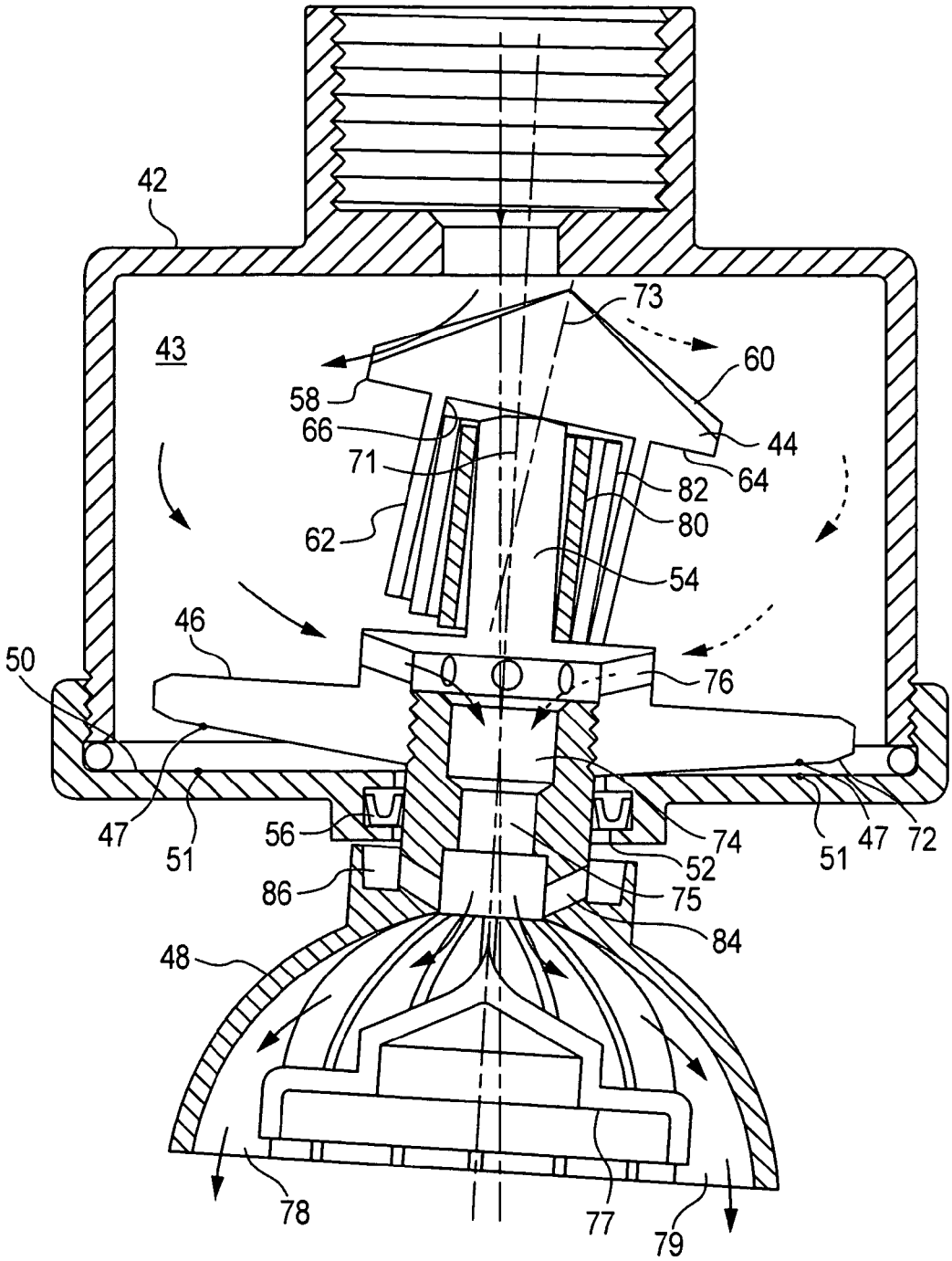
FIG. 4 (PRIOR ART)
FIG. 4 illustrates the prior art, spray head which has a wobbling feature and is disclosed in U.S. Pat. No. 6,360,964.
Figure 5:
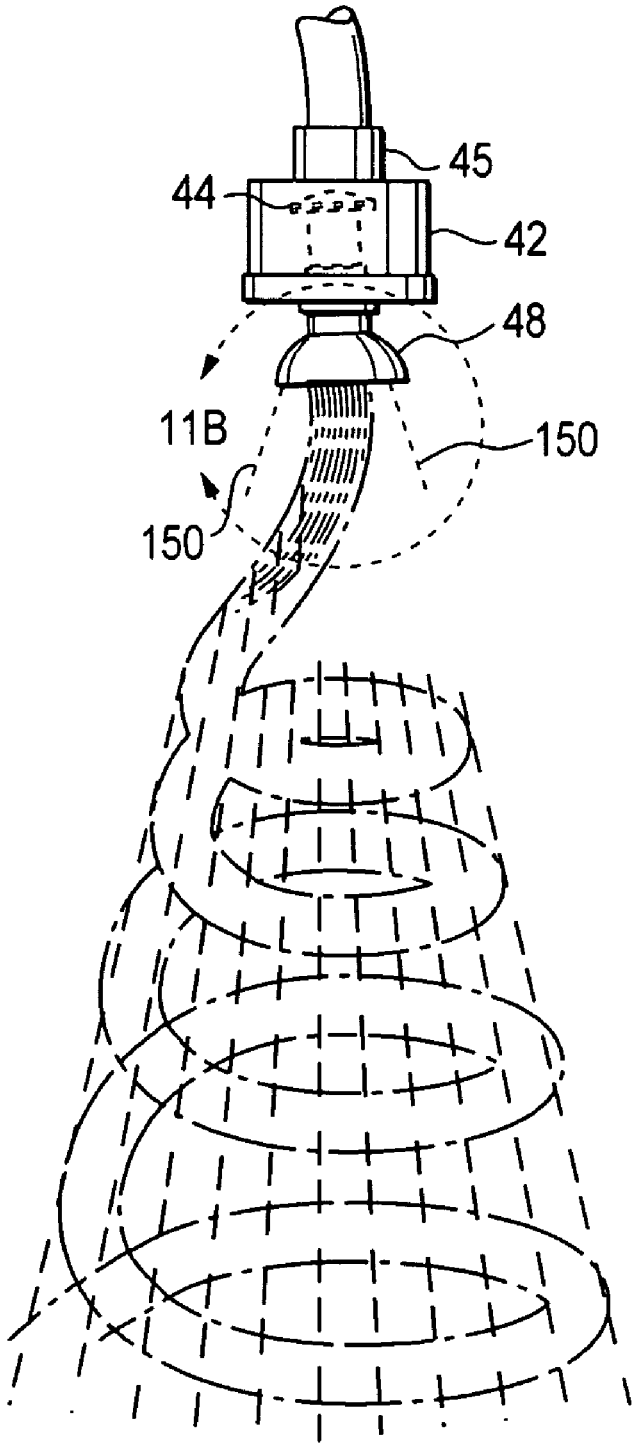
FIG. 5 (PRIOR ART)
FIG. 5 illustrates the spray flow pattern that is yielded by the spray head shown in FIG. 4.
Figure 6A:
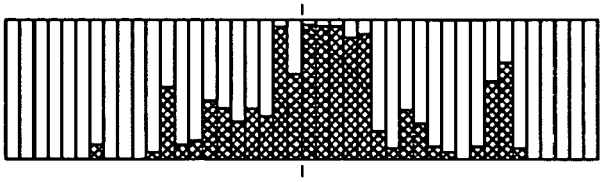
FIG. 6A (PRIOR ART)
FIGS. 6A–6D compare the spray uniformity over a specified coverage area between competitive spray heads, with that shown in FIG. 6D being the spray from the head shown in FIG. 4.
Figure 6B:
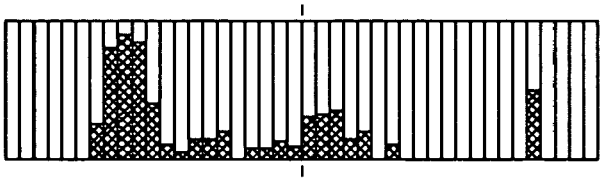
FIG. 6B (PRIOR ART)
Figure 6C:
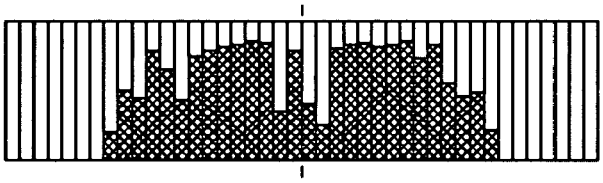
FIG. 6C (PRIOR ART)
Figure 6D:
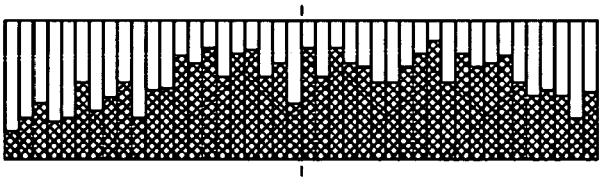
FIG. 6D (PRIOR ART)
Figure 7:
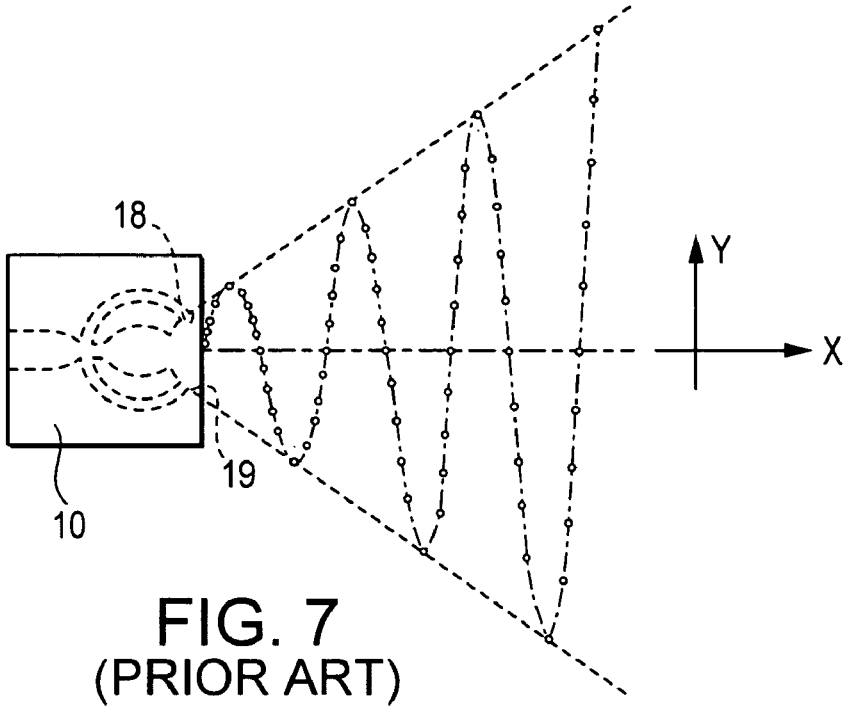
FIG. 7 (PRIOR ART)
FIG. 7 illustrates the two-dimensional, planar spray flow pattern yielded by the fluidic oscillator disclosed in U.S. Pat. No. 4,052,002.
Figure 8A:
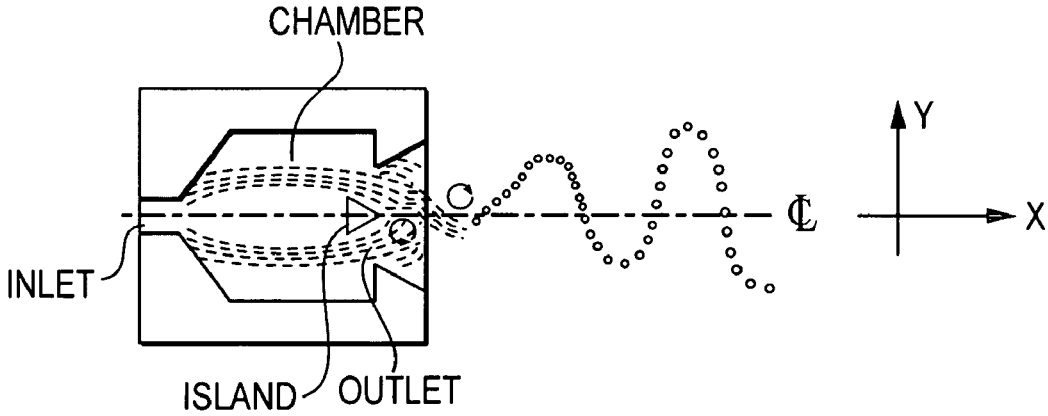
FIG. 8A (PRIOR ART)
FIG. 8A illustrates the two-dimensional, planar spray flow pattern yielded by an appropriately configured fluidic oscillator as disclosed in U.S. Pat. No. 4,151,955.
Figure 8B:
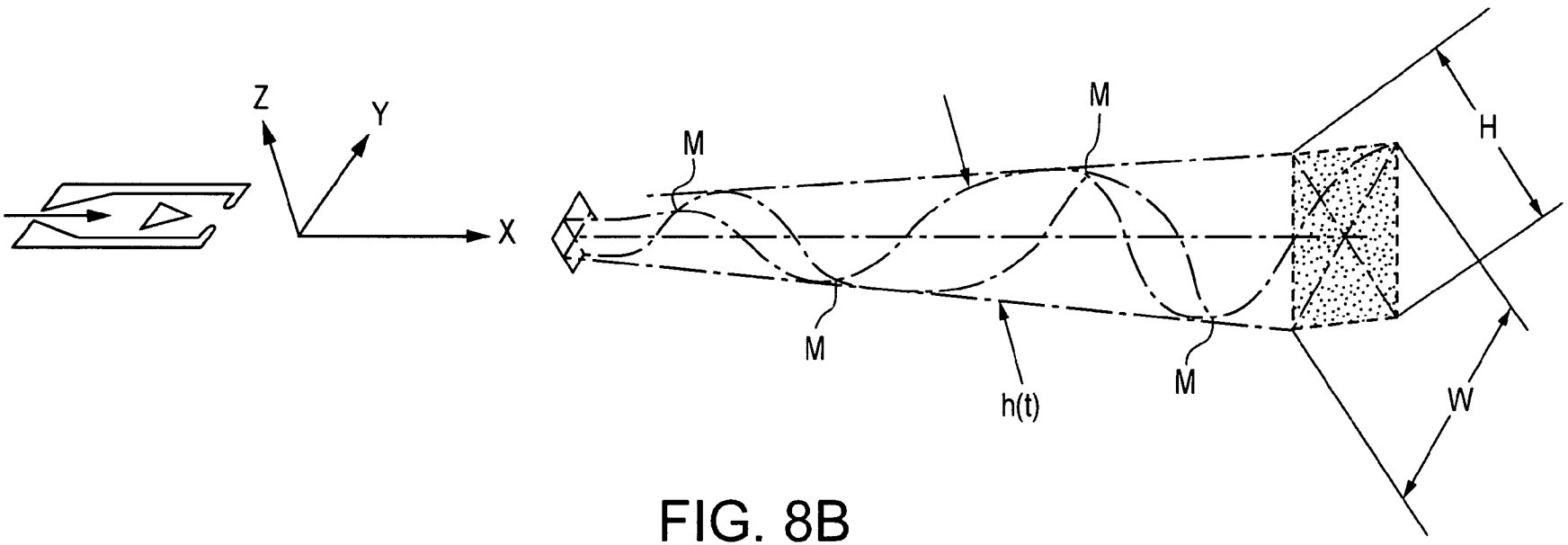
FIG. 8B (PRIOR ART)
FIG. 8B illustrates the three-dimensional, spray flow pattern yielded by an appropriately configured fluidic oscillator as disclosed in U.S. Pat. No. 4,151,955.
Figure 9:
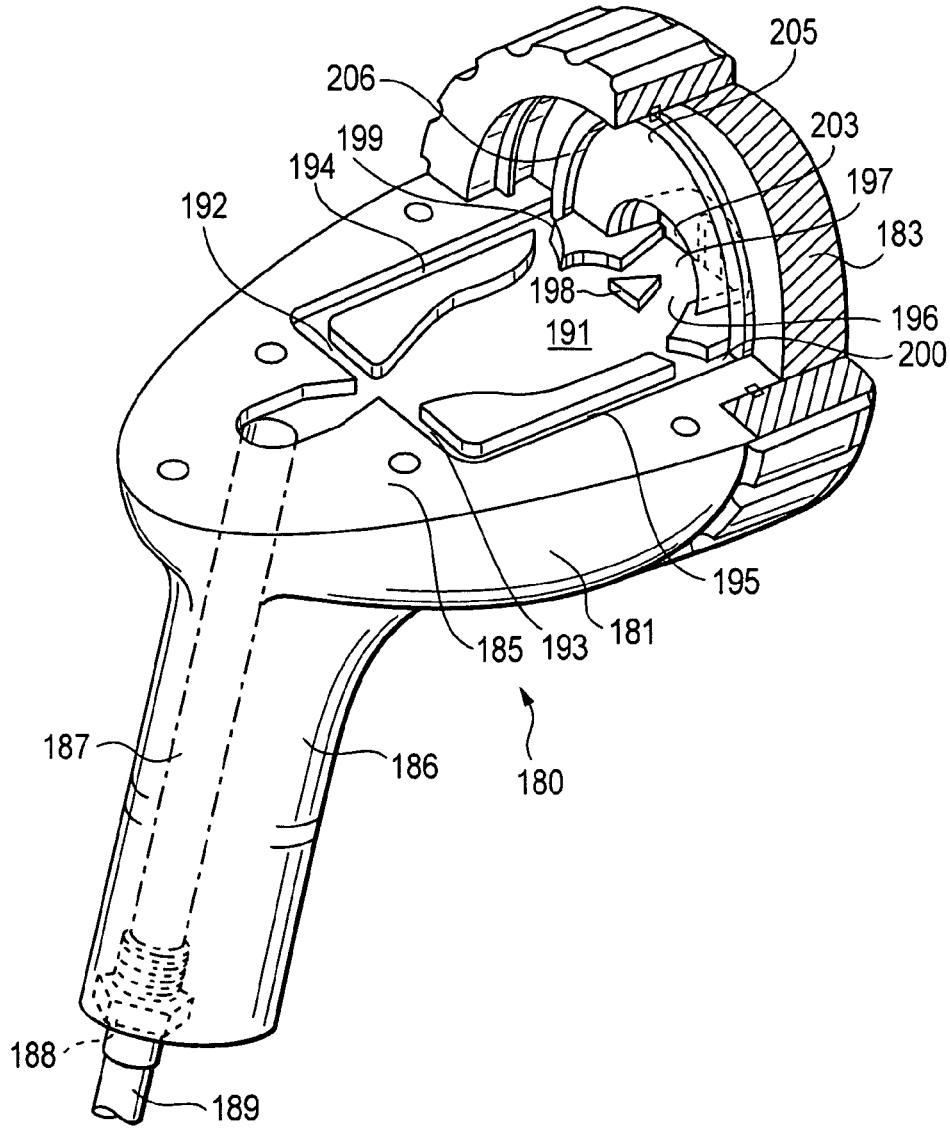
FIG. 9 (PRIOR ART)
FIG. 9 illustrates a shower head that is disclosed in U.S. Pat. No. 4,151,955 and which employs a fluid oscillator that is generally a combination of the oscillators shown in FIGS. 7 and 8A.

Before explaining at least one embodiment of the present invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

We have discovered that, by judiciously combining various fluidic oscillators, spray heads can be developed which meet all of the previously listed objects for improved spray heads. After much experimentation with various fluidic oscillators, we have overcome the technical problems associated with combining the typical two-dimensional, planar flows from single oscillators so as to yield fully three-dimensional spray patterns that provide uniform spray droplet coverage over a large surface area. Meanwhile, we have been able to overcome the problems associated with interference between sprays that are coming from oscillators held in close proximity to one another.

Figure 10:
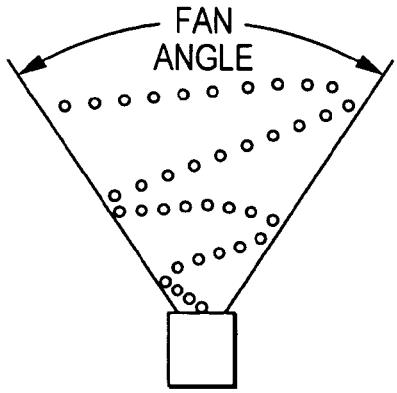
FIG. 10 shows the top view of the typical, two-dimensional distribution over a prescribed fan angle (e.g., 60 degrees) of spray droplets exiting a fluidic oscillator.

FIG. 10 shows the top view of a typical side-to-side, two-dimensional distribution over a prescribed fan angle (e.g., 60 degrees) of spray droplets exiting a fluidic oscillator. We have discovered, for a prescribed range of flow rates and operating pressures, that such planar sprays can be brought in close proximity to one another, so as to yield spatially uniformly distributed spray droplets with minimal droplet interference, if the angle of divergence between the planes of the sprays of the divergence angle of the stack is held within a critical range.

Figure 11:
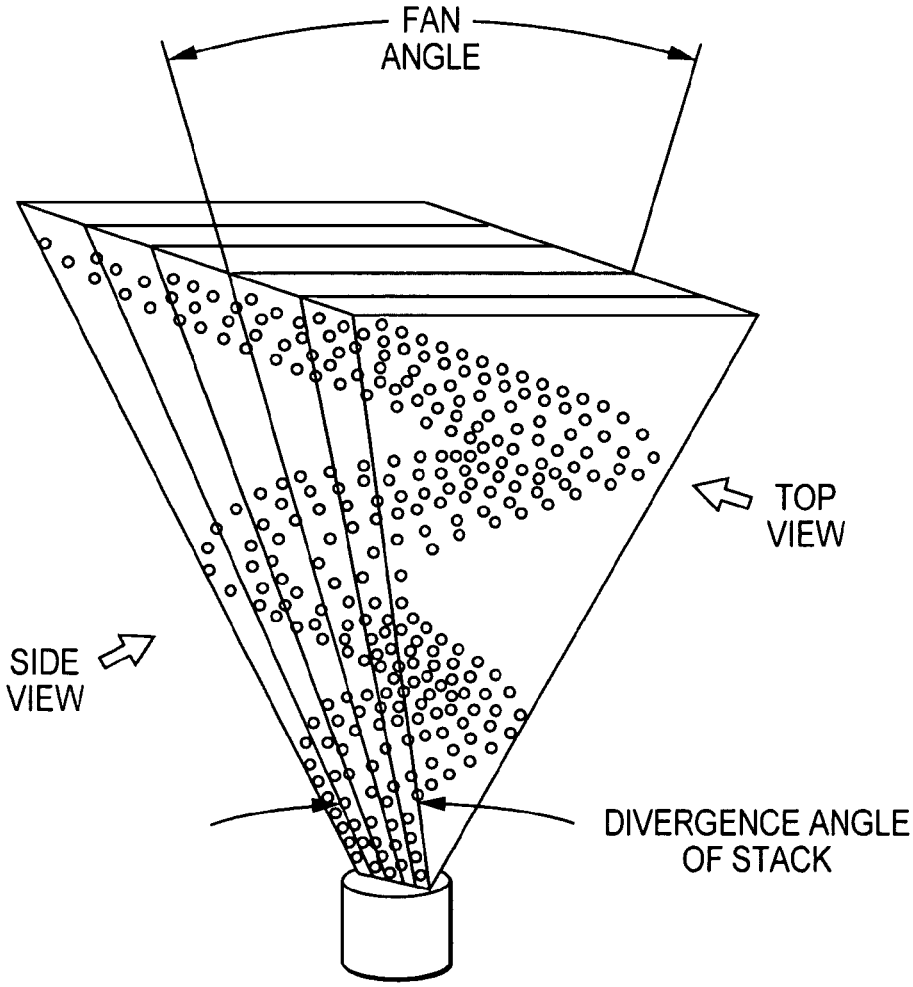
FIG. 11 illustrates the three-dimensional distribution of spray droplets that can be attained by stacking fluidic oscillators according to the present invention.
Figure 12:
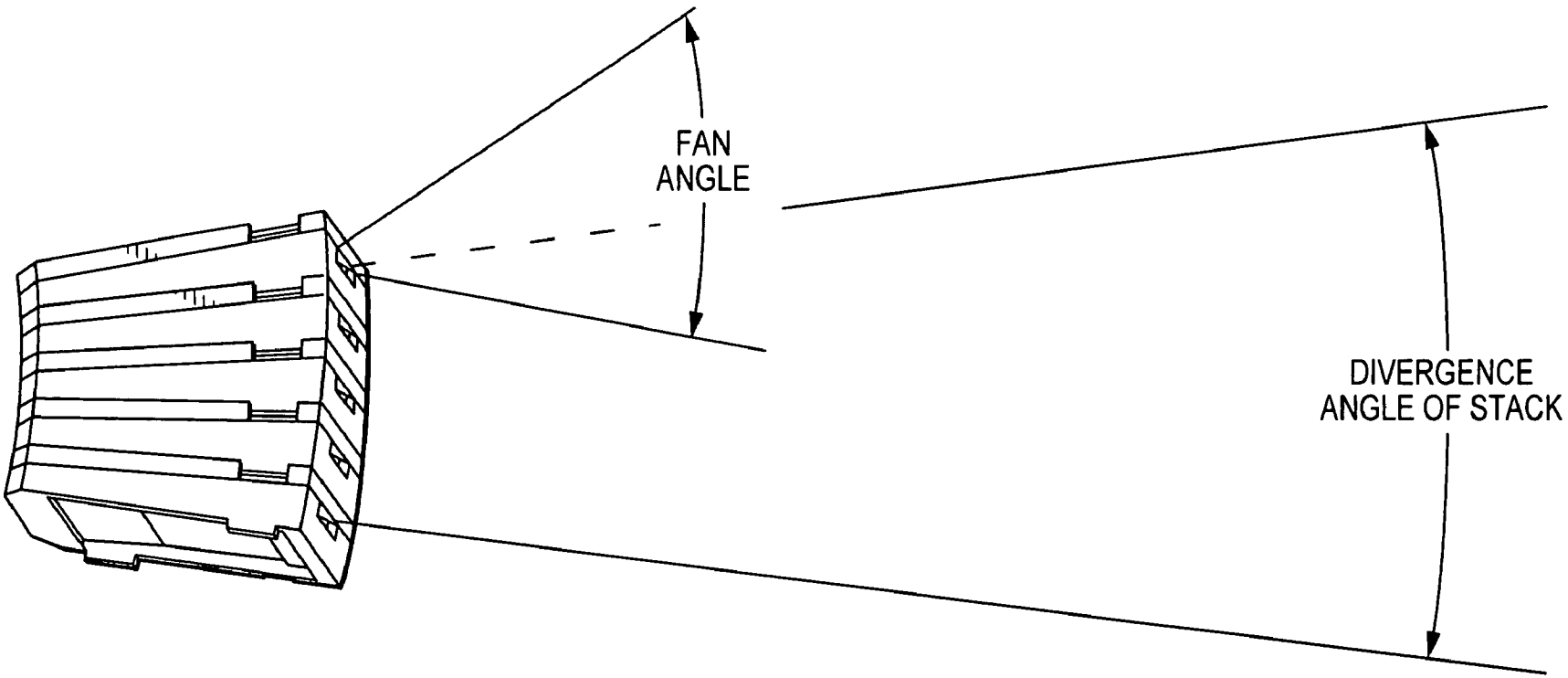
FIG. 12 shows a stack of especially constructed fluidic oscillators which are capable of achieving the spray distribution shown in FIG. 11.
Figure 13:
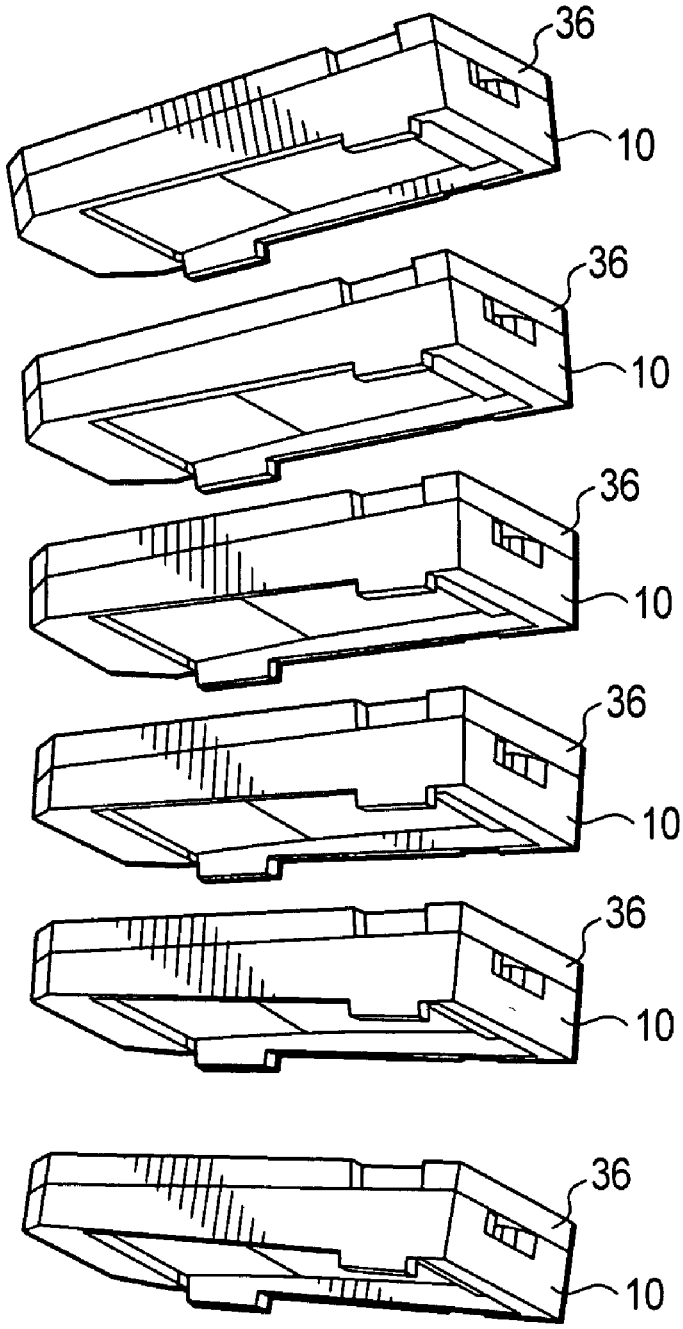
FIG. 13 which shows an exploded view of a stack, according to the present invention, of six such fluidic oscillators.

FIG. 11 illustrates the three-dimensional distribution of spray droplets that can be attained by stacking fluidic oscillators which individually yield flow patterns similar to that shown in FIG. 10. According to the present invention, FIG. 12 shows a stack of especially constructed fluidic oscillators 10 which are capable of achieving the spray distribution shown in FIG. 11. More details of this stacking arrangement are seen in FIG. 13 which shows an exploded view of a stack of six such fluidic oscillators.

Figure 14:
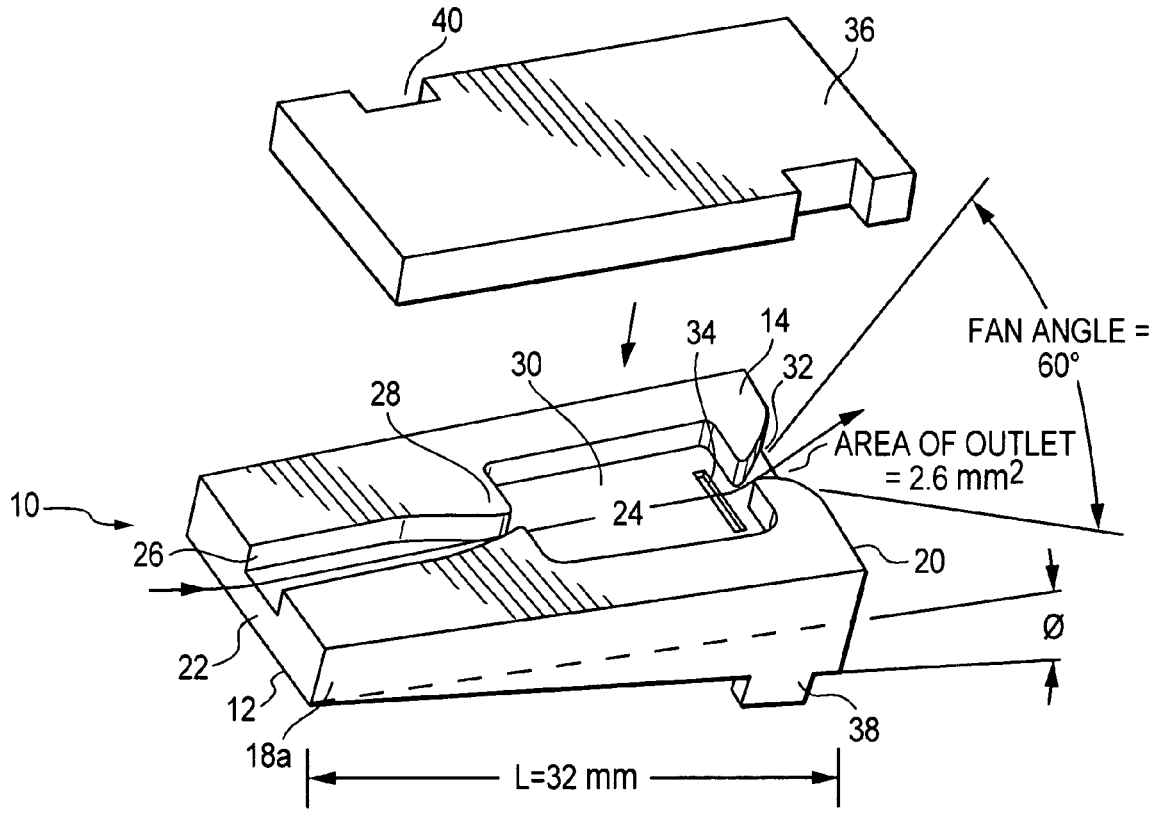
FIG. 14 shows a preferred embodiment of a fluidic oscillator that is suitable for use with the present invention.

FIG. 14 shows a preferred embodiment for a fluidic oscillator 10 that is suitable for use with the present invention. It includes a substantially rigid body member 12 having top 14, bottom 16, side 18*a*, 18*b*, front 20 and rear 22 outer surfaces. This member is preferably molded or fabricated from plastic, which is slightly deformable when subjected to compression forces exerted substantially normal to its outer surfaces. A fluidic circuit 24 is fabricated into the top outer surface. This circuit 24 takes the form of flow passage that is recessed from the top surface and molded into the member 12 so as to yield a predetermined flow path for the fluid flowing through the oscillator.

There are many different and well known designs of fluidic circuits that are suitable for use with the fluidic oscillators of the present invention. Many of these have some common features, including: an entrance 26 for flow to enter the circuit at least one power nozzle 28 configured to accelerate the movement of the liquid that flows under pressure through the oscillator, an interaction chamber 30 through which the liquid flows and in which the fluid flow phenomena is initiated that will eventually lead to the flow from the oscillator being of an oscillating nature, and an outlet 32 from which the liquid exits the oscillator. Additionally, this oscillator has a slot 34 which lies in the floor of the circuit and prior to its outlet 32. Such slots 34 have been found to increase the resulting fan angle and stability of the spray from such oscillators. See U.S. Pat. No. 5,971,301 for a further discussion of this particular fluidic oscillator.

The fluidic oscillator of FIG. 14 uses a cover plate 36 to close the top of the fluid circuit and the body member. The use of such cover plates 36, commonly known as "fliptops," is generally disclosed in U.S. Pat. No. 5,845,845.

For the present application, it was discovered that it is beneficial to fabricate such oscillators so that they are wedge shaped, with the height of their sides increasing from the rear to the front of the oscillator. This results in the adjoining oscillators, in a stack of them, having an included angle of divergence, ϕ. It is this angle of divergence which is critical in achieving minimal spray droplet interference, while also allowing close proximity of the adjoining planes of droplets so that the impact of the individual planes cannot be felt as the droplets impact upon one who is in their line of flight.

Since these oscillators will be stacked, they are also provided with protrusions 38 in their sides and wells 40 in their cover plates which promote the easy stacking of such oscillators.

To accommodate such especially designed stacks of fluidic oscillators in the housings that have become the conventional standard for spray head designs in the plumbing industry, it has been found that it is advantageous to fit such stacks of fluidic oscillators into a carrier assembly or secondary housing 42 which fits easily into any of the standard shapes for conventional spray heads. FIG. 15A demonstrates the placement of such a stack in an appropriately designed carrier assembly 42. A stopper unit 44 is seen to be used to ensure a tight seal around the line where the rear surfaces of the individual fluidic oscillators meet the bottom of the cavity 46 in the carrier assembly 42. A carrier assembly cover plate 43 is used to hold the fluidic oscillators 10 in place within the assembly.

Figure 16:
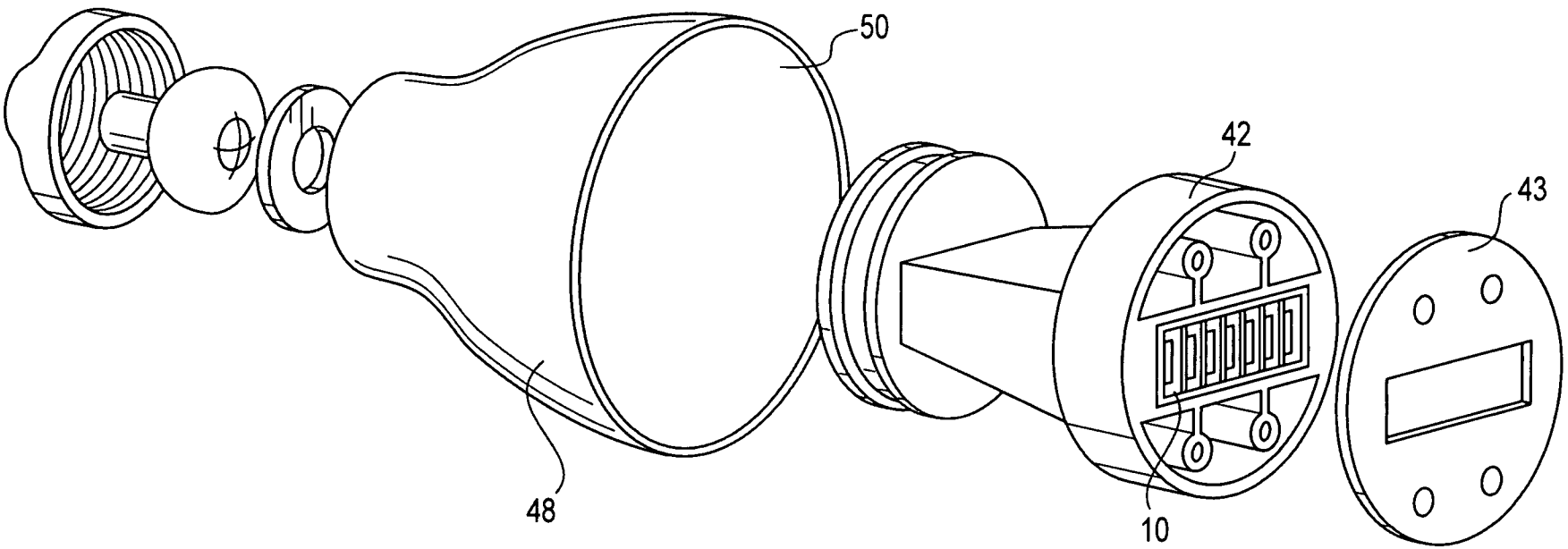
FIG. 16 shows an exploded view of a preferred embodiment of the present invention as it is fitted into a housing which is suitable for use as a spray head.
Figure 17:
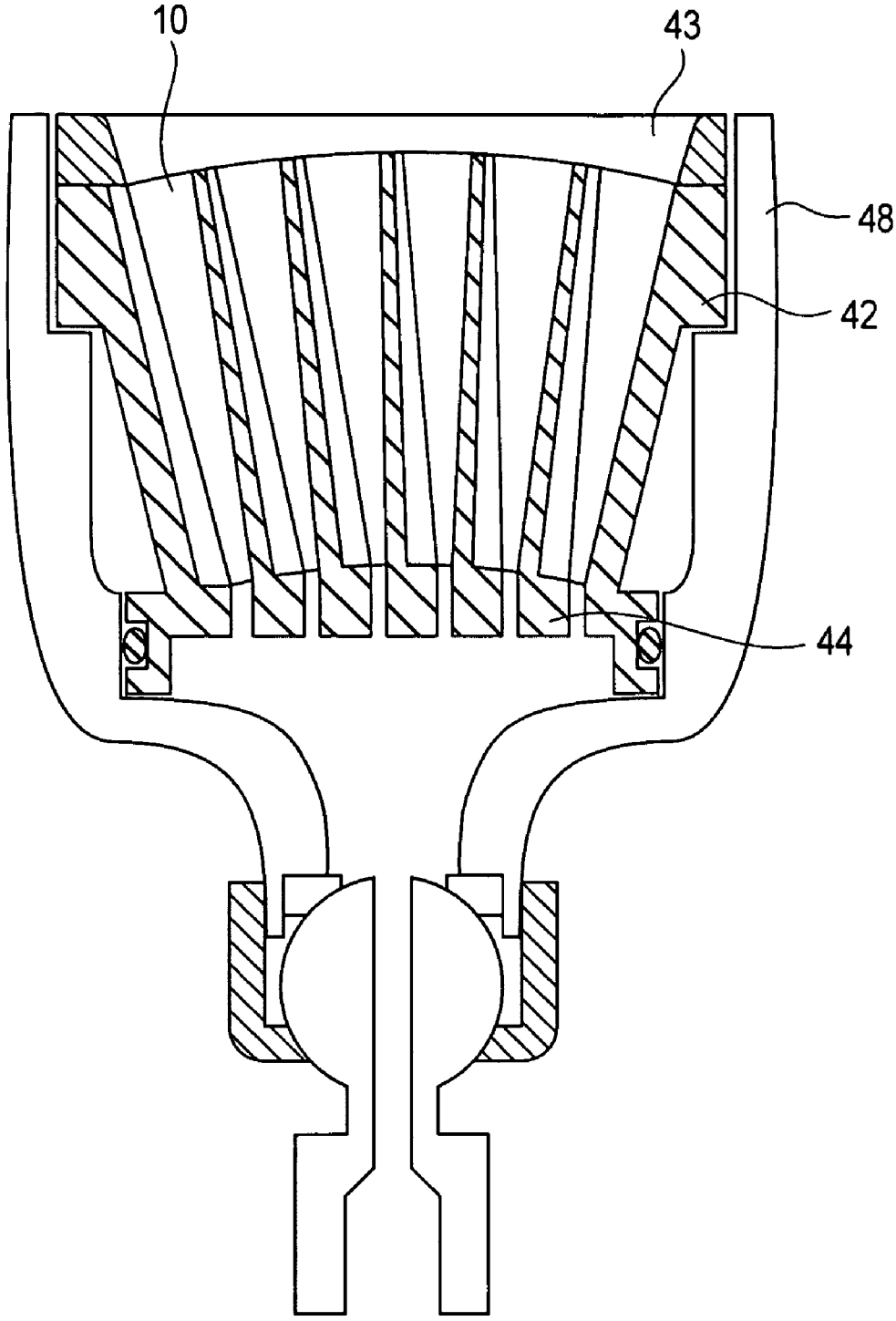
FIG. 17 shows a cross-sectional view of the assembled parts shown in FIG. 16.
Figure 18:
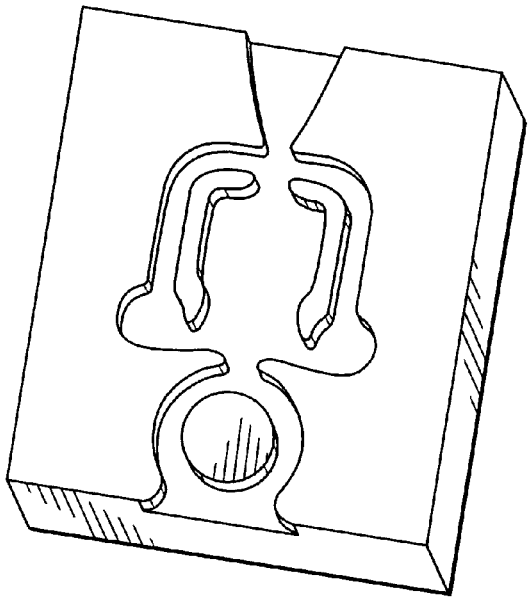
FIG. 18 (PRIOR ART)
FIG. 18 shows a perspective view and gives the operating characteristics of the fluidic oscillator disclosed in U.S. Pat. No. 5,860,603.

The present invention is intended to be fitted into a housing 48 which is suitably configured so that ti can be sued as a conventional spray head. See FIG. 16. This exploded view shows that this housing 48 having a cavity 50 into which the carrier assembly 42 is fitted. FIG. 17 shows an assembled view of this combination.

In addition to configuring the body members of fluidic oscillators so that they are wedge shaped and can be easily stacked so as to yield adjoining sprays with an adequate angle of divergence, ϕ, it is possible to use standard shaped fluidic oscillators and configure the carrier assembly 42 so that it has appropriately sized, spaced and angled (i.e., with the required angle of divergence, ϕ) slots 47 in the carrier's front surface 49 to accommodate the oscillators. In such a configuration, the fluidic oscillators may not use cover plates 36. See FIG. 15B.

To further demonstrate how the discoveries of the present invention can be used to design a desired distribution of spray droplets, consider the following example. Suppose that it is desired to uniformly cover a surface area having dimensions of 35 cm×12 cm and which is located at a distance of 30 cm in front of a spray head. Further, assume that the coverage is to be with droplets having a mean diameter of approximately 2 mm and an average velocity of approximately 4 m/sec. This is to be accomplished with a spray head operating at 1.6 gpm at approximately 10 psi and having fewer than 10 orifices so as to make these orifices large enough to minimize the possibility that they will become clogged.

Until the teachings of the present invention, this task would have been virtually impossible since the known spray devices that could cover the targeted area cannot do so uniformly with droplets of the desired size and velocity. However, we have discovered that the above requirements can be met by assembling a stack of six fluidic oscillators such as that shown in FIG. 14 (with the individual oscillators sized so that they each have an orifice area of approximately 2.6 $mm^2$) if the angle of divergence, ϕ, between the individual oscillators is held in the range of approximately 2–5 degrees, with a preferred setting being 3.8 degrees.

In this stacked arrangement, such fluidic oscillators are observed to oscillate at a frequency of approximately 50 hertz and with the wavelength of these oscillations being approximately 10 cm. The result is a large area spray that to the human touch has very pleasing, vigorous (because of the relatively high velocity and large diameter of the droplets) massaging qualities.

Furthermore, this spray is achieved at surprisingly low flow rates (i.e., ranges of 1.2–1.9 gpm versus non-fluidic, spray heads operating in the range of 2.0–2.5 gpm) as compared to those used by the currently available, non-fluidic, massaging spray heads which cover significantly smaller surface areas.

While the above discussion has centered on our discoveries with respect to stacks of specialized fluidic oscillators, it should be noted that we have also been able to develop some specialized, individual fluidic oscillators that can provide side-to-side sweeping sprays which cover relatively large areas. For various bathing applications, the keys to making such oscillators perform so as to give desirable tactile sensations to their users is to configure the circuits of such oscillators so that their sweeping frequencies are in the range of 10–60 hertz.

With a wide range of fluidic circuits from which to chose and with many of these offering quite different flow characteristics, it would appear that there exists an almost infinite number of especially designed spray droplet distributions that can be achieved by judiciously stacking currently available fluidic oscillators. To assist in guiding such development tasks, FIGS. 18–23 disclose various, commercially available (Bowles Fluidics Corporation, Columbia, Md.) fluidic circuits that are available for special spray head design needs.

Figure 19:
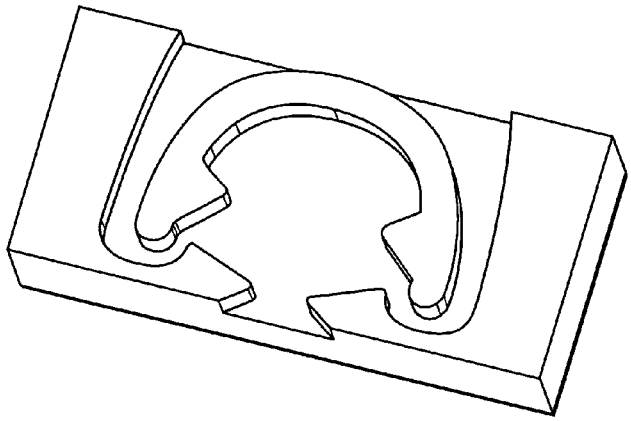
FIG. 19 (PRIOR ART)
FIG. 19 shows a perspective view and gives the operating characteristics of the fluidic oscillator disclosed in U.S. Pat. No. 6,253,782.
Figure 20:
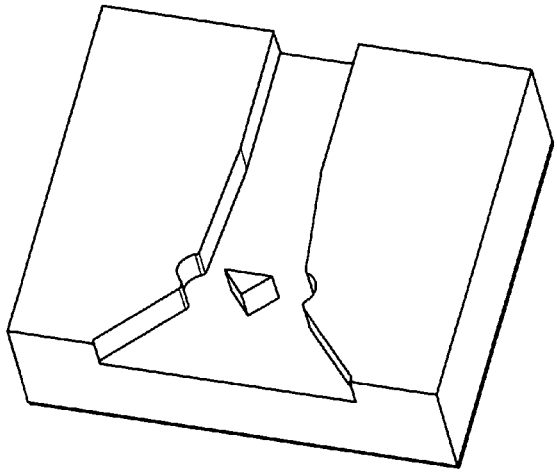
FIG. 20 (PRIOR ART)
FIG. 20 shows a perspective view and gives the operating characteristics of the fluidic oscillator disclosed in U.S. Pat. No. 4,151,955.
Figure 21:
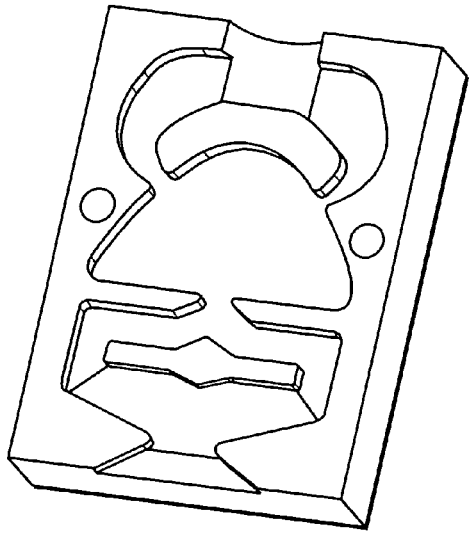
FIG. 21 (PRIOR ART)
FIG. 21 shows a perspective view and gives the operating characteristics of the fluidic oscillator disclosed in U.S. Pat. No. 6,253,782.
Figure 22:
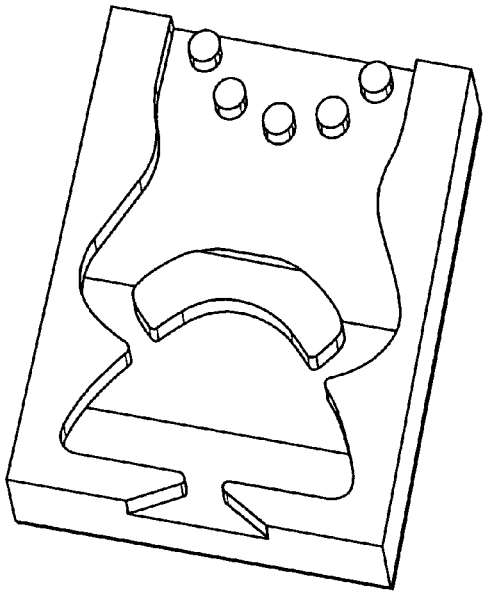
FIG. 22 (PRIOR ART)
FIG. 22 shows a perspective view and gives the operating characteristics of the fluidic oscillator disclosed in U.S. Pat. No. 6,253,782.
Figure 23:
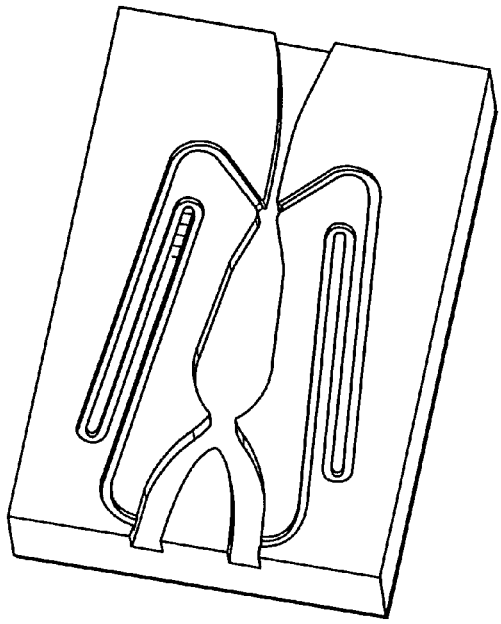
FIG. 23 (PRIOR ART)
FIG. 23 shows a perspective view and gives the operating characteristics of the fluidic oscillator disclosed in U.S. Pat. No. 3,563,462.

Also shown on FIGS. 18–23 is data regarding the size and operating characteristics of these oscillators. Additionally, it should be noted that the fluidic circuits revealed in FIGS. 19, 22 and 23 provide flows having essentially two-dimensional flow patterns, while the fluidic circuits shown in FIGS. 16, 20, and 21 (note: this circuit yields a special type of swirling jet) provide flows having essentially three-dimensional flow patterns.

This data may be used to design a wide variety of spray heads having unique spray droplet distributions. All of these design are considered to come within the bounds of the invention disclosed herein. For example, to design a spray head to uniformly cover a desired spray area (e.g., vertical=34.5 cm×horizontal=16 cm at 30 cm from the spray head) one can see by simple geometry that a vertically oriented oscillator with a fan angle of 60 degrees will give the desired vertical coverage. Furthermore, assuming the side of the oscillator is made with an angle of divergence, ϕ, of 3.8 degrees, simple geometry will again show that a stack of approximately eight such 60 degree fan angle oscillators will give the desired coverage. To obtain desired other properties for such a spray (e.g., flow rate, average droplet size and velocity, a desired pulsation frequency), choices will have to be made among the various 60 degree fan angle oscillators according to their specified operating characteristics.

Figure 24A:
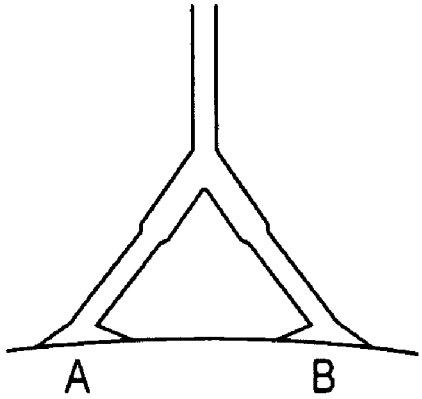
FIGS. 24A–24B illustrate the flow rate savings available for bathing applications when using an oscillating spray having a frequency >30 hertz.
Figure 24B:
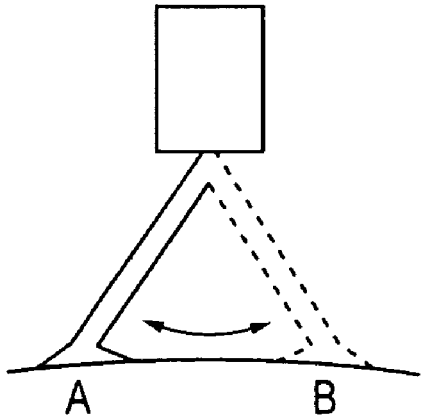

As previously mentioned, for bathing purposes, significant flow rate reductions and energy savings are possible using spray heads equipped with especially designed stacks of fluidic oscillators. The reasoning behind this statement is further clarified by FIGS. 24A–24B. In FIG. 24A, a Y-connector is shown which splits a 2.5 gpm stream into two 1.25 gpm sprays or jets. Suppose that these two jet sprays simultaneously impinge the skin of a bather at points A and B so as to produce some feeling of their presence (e.g., pressure and temperature changes on the skin). Meanwhile, FIG. 24B shows a 1.25 gpm jet being swept to and fro by a fluidic oscillator.

As previously noted, as long as the frequency of the oscillation is well below the maximum of human tactual perception (about 30–60 Hz), the alternate arrival of the single jet at two different points, A and B, is interpreted by a human's tactile senses as arriving at different times. But when the frequency of oscillation is increased to this range and above this maximum, the jets are perceived as arriving at A and B at the same time. In other words the single sweeping jet feels much the same as the dual jets of the Y-connector. A water saving is inherently achieved since the sweeping, single jet has half of the flow of the dual jet.

Additionally, it can be noted that a bather using a spray head which employs such fluidic oscillators operating at >60 hertz (i.e., non-massaging to human tactile perceptions) will experience the feeling that a lot more water is passing through such a spray head when it is operating within the statutorily limited upper flow rate of 2.5 gpm. For such a bather, "less water feels like more." Since many bathers are reported to enjoy and prefer higher spray head flow rates, spray heads using fluidic oscillators in the manner disclosed herein would appear to have a significant advantage in the marketplace. This advantage is also complimented by the higher degree of control for selecting droplet size, velocity and distribution that can be engineered to spray heads which utilize fluidic oscillators as disclosed herein.

Meanwhile, the operating characteristics of fluidic oscillators, depending of the fluidic's design, can be made to occur at very precise set points within what are exceedingly large ranges of possible set points. In addition to operating parameters such as mean droplet size and velocity, average pulsation frequency, and the spray's lateral fan angle, fluidic oscillator's can also be shaped to provide a vertical fan angle and to control the nature of the oscillator's pulsations (e.g., as represented by a square wave which gives a heavier flow at the spray's extreme points of coverage, or a triangular wave which gives a more uniform distribution of drops over the whole coverage area). Additionally, as previously mentioned, the heating and perceivable wetting characteristics of such sprays are very dependent on the size of the droplets which comprise the sprays. Thus, a fluidic oscillator's ability to control droplet sizes also allows fluidic oscillators to be especially useful when control of a spray's heat transfer characteristics are a major design consideration.

To provide maximum design flexibility in the design of a spray head using a stack of fluidic oscillators, it should be recognized that the oscillators in the stack need not be all of the same kind. For example, oscillators with differing fan angles, oscillation frequencies, droplet sizes and velocities can be stacked together to yield an almost infinite number of sprays. All of these combinations are considered to be within the teachings of the present invention.

Figure 25:
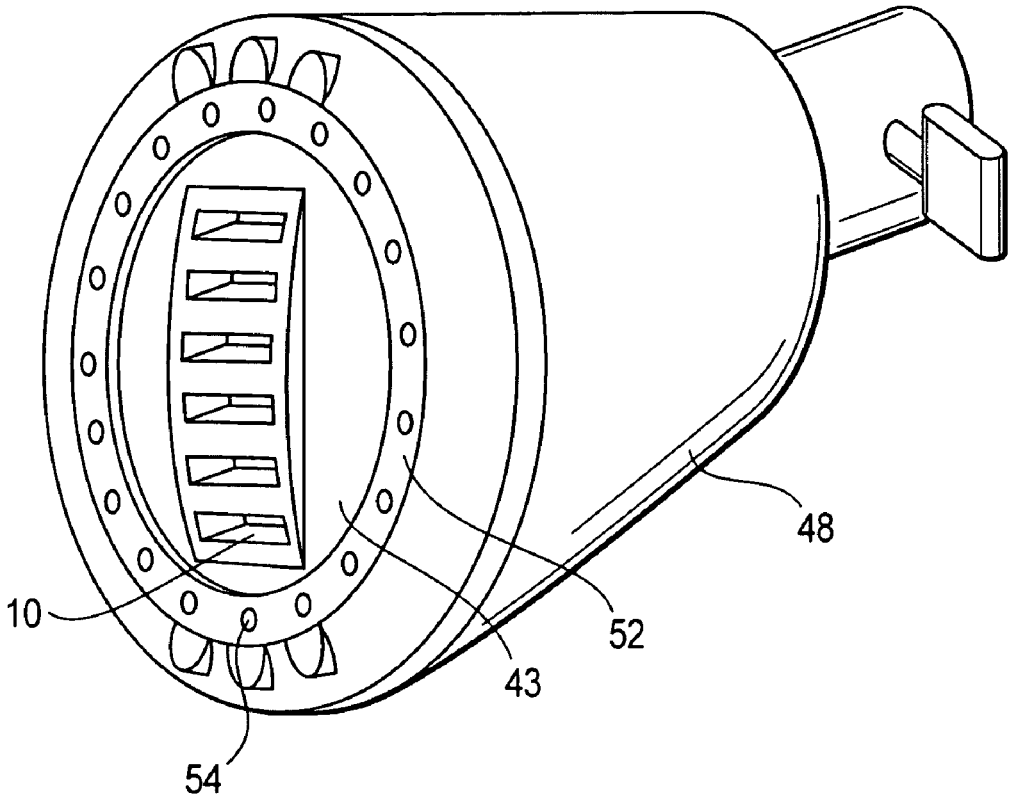
FIG. 25 shows a perspective view of a preferred embodiment of the present invention.

Additionally, it can be noted that one can design a spray head such that it has both conventional capabilities and those available by using fluidic oscillators into single spray head. See FIG. 25 where a spray head is shown that utilizes an array of fluidic oscillators in the center of the front surface of the spray head, with this array being surrounding by a ring 52 of orifices 54 that emit a conventional spray.

The foregoing is considered as illustrative only of the principles of the invention. Further, since numerous modifications and changes will readily occur to those skilled in the art, and because of the wide extent of the teachings disclosed herein, the foregoing disclosure should not be considered to limit the invention to the exact construction and operation shown and described herein. Accordingly, all suitable modifications and equivalents of the present disclosure may be resorted to and still considered to fall within the scope of the invention as hereinafter set forth in the claims.

We claim:

1. A spray head comprising:

a plurality of fluidic oscillators, each oscillator having a body member with top, bottom, side, front and rear outer surfaces, each oscillator having a fluidic circuit embedded in said top surface, said circuit forming a path in which a fluid may flow through said oscillator, each said fluidic circuit having a fluid inlet, a power nozzle, an interaction chamber and an outlet in said front surface from which a fluid may exit said oscillator, wherein said oscillators being stacked one on top of the other, wherein said body member being configured so that said oscillators stack such that the flow of fluid from adjoining oscillators in said stack have an angle of divergence between the centerlines of the planes defined by the flows from the outlets of said adjoining oscillators.

2. A spray head as recited in claim 1 further comprising a plurality of cover plates, wherein each said cover plate is configured, and is proximate the top surface of one of said fluidic oscillators, and is attached to said oscillator so as to provide a seal against the leakage of fluid from the top surface of said oscillator.

3. A spray head as recited in claim 2 further comprising a carrier assembly having a front and a rear surface and a cavity extending between said assembly surfaces, wherein said cavity configured so to receive and hold said stack of fluidic oscillators.

4. A spray head as recited in claim 3 further comprising a stopper unit that attaches to the rear surface of said assembly so as to provide a seal against the leakage of fluid from said assembly rear surface.

5. A spray head as recited in claim 1 wherein said angle of divergence is in the range of 2–5 degrees.

6. A spray head as recited in claim 2 wherein said angle of divergence is in the range of 2–5 degrees.

7. A spray head as recited in claim 3 wherein said angle of divergence is in the range of 2–5 degrees.

8. A spray head as recited in claim 1, wherein:

said fluidic circuits are configured to operate with a specified flow rate and to exhibit sweeping frequencies chosen from the group consisting of frequencies in the range of 10–60 cps or greater than 60 cps.

9. A spray head as recited in claim 8, wherein:

said flow rate is chosen from the group consisting of flow rates of 1.2–1.9 gpm or 2.0–2.5 gpm.

10. A spray head as recited in claim 3, wherein:

said fluidic circuits are configured to operate with a specified flow rate and to exhibit sweeping frequencies chosen from the group consisting of frequencies in the range of 10–60 cps or greater than 60 cps.

11. A spray head as recited in claim 10, wherein:

said flow rate is chosen from the group consisting of flow rates of 1.2–1.9 gpm or 2.0–2.5 gpm.

12. A spray head as recited in claim 7, wherein:

said fluidic circuits are configured to operate with a specified flow rate and to exhibit sweeping frequencies chosen from the group consisting of frequencies in the range of 10–60 cps or greater than 60 cps.

13. A spray head as recited in claim 12, wherein:

said flow rate is chosen from the group consisting of flow rates of 1.2–1.9 gpm or 2.0–2.5 gpm.

* * * * *